US005297923A

United States Patent [19]

Boriani et al.

[11] Patent Number: 5,297,923

[45] Date of Patent: Mar. 29, 1994

[54] DEVICE FOR PARTING AND SUCCESSIVELY FEEDING STACKED ELEMENTS OF SHEET MATERIAL TO A USER MACHINE

[75] Inventors: Silvano Boriani; Antonio Gamberini, both of Bologna, Italy

[73] Assignee: G.D Societa' per Azioni, Bologna, Italy

[21] Appl. No.: 12,928

[22] Filed: Feb. 3, 1993

[30] Foreign Application Priority Data

Feb. 7, 1992 [IT] Italy ..... BO92A 000035

[51] Int. Cl.[5] ..... B65H 3/00

[52] U.S. Cl. ..... 414/795.4; 414/923; 414/797.6; 271/9; 271/145; 271/163; 271/95; 271/35

[58] Field of Search ..... 221/187, 186, 204, 205, 221/242, 253, 241; 271/9, 171, 145, 162, 163, 165, 33, 35, 95; 414/795.4, 923, 798.9, 797.6, 795.8, 789.6

[56] References Cited

U.S. PATENT DOCUMENTS

| | | | |
|---|---|---|---|
| 2,764,408 | 9/1956 | Weiler | 271/33 |
| 3,622,149 | 11/1971 | Enskat | 271/35 |
| 5,131,899 | 7/1992 | Nagahashi et al. | 414/798.9 |

FOREIGN PATENT DOCUMENTS

| | | | |
|---|---|---|---|
| 0236942 | 11/1985 | Japan | 271/9 |
| 1316328 | 5/1973 | United Kingdom . | |

*Primary Examiner*—H. Grant Skaggs
*Attorney, Agent, or Firm*—Klauber & Jackson

[57] ABSTRACT

A device wherein at least one feedbox housing a stack of sheet elements presents a first and second wall parallel to each other, and an actuating device for moving the two walls in relation to and parallel to each other, so as to define a channel varying in width between a maximum and minimum value; the section of the channel at maximum width being approximately equal to but no smaller than the surface of the sheet element.

6 Claims, 4 Drawing Sheets

DEVICE FOR PARTING AND SUCCESSIVELY FEEDING STACKED ELEMENTS OF SHEET MATERIAL TO A USER MACHINE

BACKGROUND OF THE INVENTION

The present invention relates to a device for parting and successively feeding stacked elements of sheet material to a user machine.

In the following description, specific reference is made, purely by way of example, to a device for parting and feeding stacked, particularly die-cut, labels to a user machine, particularly a packing machine.

On known devices of the aforementioned type, the labels are usually placed inside a normally tubular feedbox with an open output end from which the labels are withdrawn successively by a withdrawal device and with the aid of a parting device. Known parting devices are normally mounted on the feedbox, and generally comprise a roller or similar movable member, which, when brought into contact with the lateral surface of the stack of labels inside the feedbox, provides for successively deforming and so separating the labels.

Despite effectively separating the stacked labels, known parting devices of the aforementioned type invariably result in a certain amount of damage to at least one lateral edge of the labels. What is more, the movable parting member requires the use of a complex, high-cost activating device.

SUMMARY OF THE INVENTION

It is an object of the present invention to provide a device for parting and successively feeding stacked elements of sheet material to a user machine, designed to overcome the aforementioned drawbacks.

According to the present invention, there is provided a device for parting and successively feeding stacked elements of sheet material to a user machine, the device comprising at least one feedbox designed to receive a stack of said elements; characterized by the fact that said feedbox comprises a first and second wall parallel to each other; and that actuating means are provided for moving said two walls, in relation to and parallel to each other, between a first and second relative position, and so as to define a channel varying in width between a maximum and minimum value; the section of the channel, when said width is maximum, being approximately equal to but no smaller than the surface of said element.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
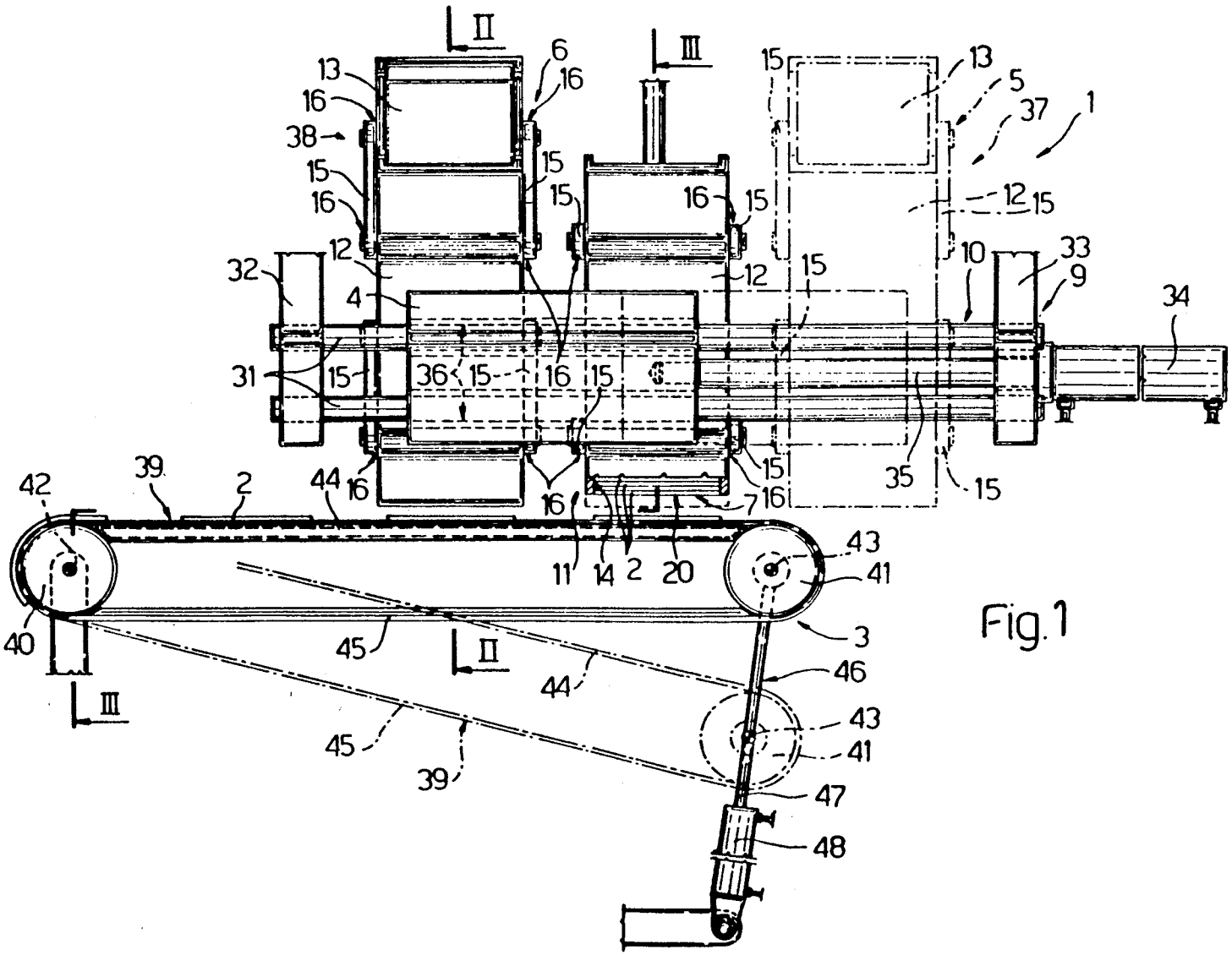
FIG. 1 shows a side view of a first preferred embodiment of the device according to the present invention.

Number 1 in FIG. 1 indicates a feedbox device for feeding sheet material, in particular labels 2, to a production machine (not shown) featuring a device 3 for successively withdrawing labels 2 from device 1.

In the example shown, device 1 comprises a carriage 4 supporting two feedboxes 5, 6 designed to receive respective stacks 7, 8 of labels 2; and an actuating device 9 for moving carriage 4 back and forth and so moving each feedbox 5, 6 along a guide 10 and to and from a withdrawal station 11 wherein feedbox 5, 6 cooperates with withdrawal device 3.

Each feedbox 5, 6 comprises a first fixed wall 12 integral with carriage 4; a second wall 13 extending parallel to wall 12 and defining, with wall 12, a channel 14 for housing stack 7, 8 and conveying respective labels 2 to withdrawal device 3; and two pairs of intermediate cross members 15, each of which is a crank connected to walls 12 and 13 by respective hinges 16, so as to define, with walls 12 and 13, an articulated quadrilateral.

On the opposite side to that facing withdrawal device 3, walls 12 and 13 define an opening 17 for inserting labels 2 inside channel 14; and, on the side facing withdrawal device 3, walls 12 and 13 terminate with respective appendixes 18 and 19 arranged facing each other and defining an opening 20 through which labels 2 are withdrawn from channel 14.

Wall 13 of each feedbox 5, 6 is connected to a respective adjusting device 21 supported in a fixed position on a frame (not shown), and which provides for moving wall 13 in relation to wall 12, and between a first or loading position (FIG. 2) wherein cross members 15 are perpendicular to walls 12 and 13, and channel 14 is of maximum width with a section approximately equal to but no smaller than that of respective undeformed stack 7, 8; and a second or operating position (FIG. 3) wherein cross members 15 and the plane of output opening 20 slope in relation to walls 12 and 13.

Figure 2:
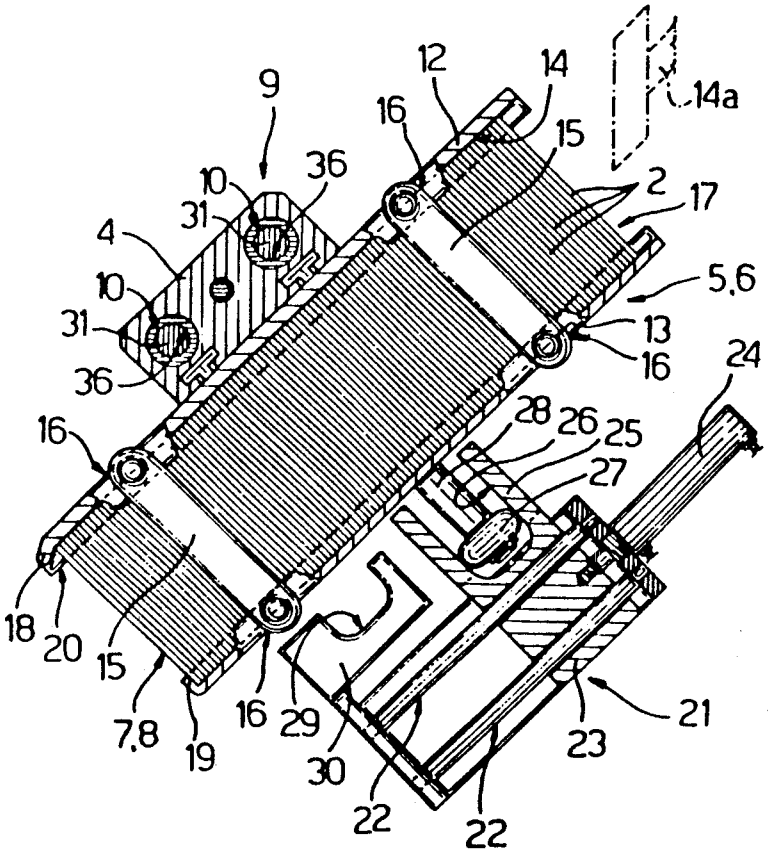
FIG. 2 shows a section along line II—II in FIG. 1.
Figure 3:
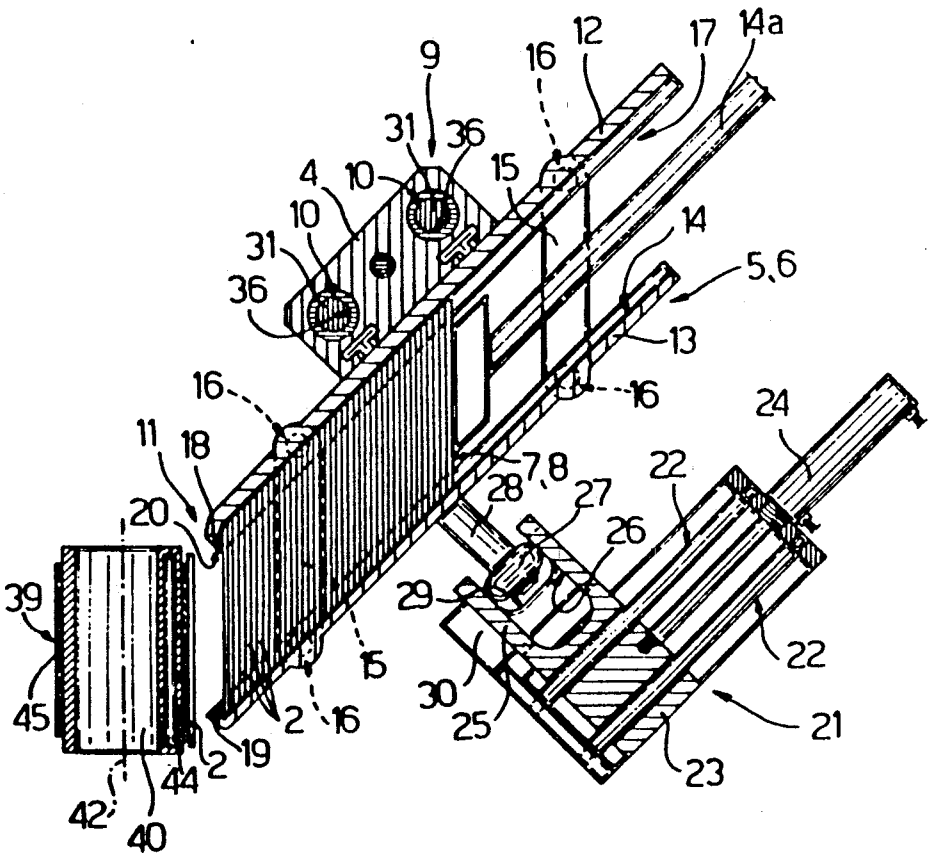
FIG. 3 shows a section along line III—III in FIG. 1.

With reference to FIGS. 2 and 3, each device 21 comprises a guide 22 defined by two rods extending parallel to channel 14 of respective feedbox 5, 6; a slide 23 connected to guide 22; and an actuating cylinder 24 connected to slide 23, for moving it back and forth along guide 22. Each device 21 also comprises a fork 25 integral with slide 23 and facing wall 13, so as to define a channel 26 extending perpendicular to guide 22 and the FIGS. 2 and 3 plane, and parallel to guide 10, and which is engaged by a roller 27 mounted for rotation on a pin 28 extending perpendicularly from wall 13 and outwards in relation to channel 14. When roller 27 of wall 13 engages fork 25, and slide 23 is moved along guide 22 from the backup position in FIG. 2 to the forward position in FIG. 3, respective wall 13 is moved from said loading to said operating position.

When slide 23 is set to the forward position, channel 26 of each fork 25 is aligned with a similar channel 29 of a fixed guide 30 extending between the two devices 21 and parallel to guide 10, and designed to receive rollers 27 when respective walls 13 are set to the operating position.

With reference to FIGS. 1 to 3, guide 10 of actuating device 9 is defined by two parallel rods 31, the ends of which, on either side of adjusting devices 21, are supported on two fixed brackets 32 and 33. Bracket 33 also supports the body of an actuator 34, the output rod 35 of which extends through bracket 33 and parallel to rods 31, and presents its free end connected to carriage 4, which presents two through holes 36, each engaged in sliding manner by a respective rod 31.

As shown in FIG. 1, actuator 34 provides for moving feedboxes 5 and 6 between withdrawal station 11, common to both feedboxes 5 and 6, and respective loading stations 37 and 38 located symmetrically on either side of station 11. More specifically, carriage 4 is so sized that, when one of feedboxes 5, 6 is moved into withdrawal station 11, the other is moved into respective loading station 37, 38. Moreover, by virtue of channel 29 of fixed guide 30 only being aligned with channel 26 of fork 25 when respective wall 13 is in the operating position, each feedbox 5, 6 may only be moved to and from withdrawal station 11 when respective wall 13 is in said operating position.

Inside withdrawal station 11, opening 20 of feedbox 5, 6 is positioned facing the outer surface of a known endless suction belt 39 forming part of withdrawal device 3, which also comprises two guide rollers 40 and 41 (one of which is powered) supporting belt 39 and rotating about respective axes 42 and 43 perpendicular to guide 10 and to the FIG. 1 plane. Rollers 40 and 41 divide belt 39 into a delivery branch 44 facing feedboxes 5 and 6, and a return branch 45. Roller 41 is supported for rotation on a fork 46 connected integral with the output rod 47 of an actuator 48, and which is moved, by actuator 48, between a backup position (dotted line in FIG. 1) and a forward position (continuous line in FIG. 2) wherein branch 44 of belt 39 extends through withdrawal station 11, and provides for engaging, by suction, the bottom label 2 in stack 7, 8 inside feedbox 5, 6 in withdrawal station 11.

In actual use, when carriage 4 of actuating device 9 is set to a first limit position (FIG. 2) wherein feedbox 6 is in loading station 38, feedbox 5 is in withdrawal station 11, roller 27 of feedbox 6 engages fork 25 of respective adjusting device 21, and slide 23 of device 21 is in the backup position, channel 14 of feedbox 6 is of maximum width, thus enabling stack 8 of labels 2 to be inserted inside feedbox 6.

When inserted inside channel 14, stack 8 is in the form of a rectangular parallelogram with labels 2 arranged perpendicular to walls 12 and 13. As labels 2 are normally die-cut, the lateral edges of the labels invariably cling together, thus making successive withdrawal of the labels through opening 20 extremely difficult, if the labels, pushed towards opening 20 by a piston 14*a*, are not first separated by moving respective slide 23 into the forward position. This in fact provides for narrowing channel 14, so that labels 2 slide one on top of the other into the inclined position shown in FIG. 3, wherein labels 2, still parallel to opening 20, are arranged parallel to delivery branch 44 of belt 39 and to labels 2 in stack 7 in withdrawal station 11.

When labels 2 in stack 7 run out, a sensor (not shown) provides for operating actuator 34, which moves carriage 4 into a second limit position (dotted line in FIG. 1) wherein feedbox 5 is in loading station 37, respective roller 27 engages fork 25 of respective adjusting device 21, feedbox 6 is in withdrawal station 11, and respective roller 27 engages channel 29 of fixed guide 30 so as to maintain respective wall 13 in the operating position.

At this point, a fresh stack 7 of labels 2 is loaded into feedbox 5, while labels 2 in stack 8 are withdrawn successively through opening 20 by device 3, the belt 39 of which is moved forward in steps and, at each step, is pushed by actuator 48 towards opening 20 so as to engage label 2, and then detached from opening 20 so as to withdraw label 2 from feedbox 6.

The above cycle is repeated until labels 2 in stack 8 run out, and actuator 34 is again operated for moving carriage 4 into the other limit position.

According to a variation not shown, actuating device 9 may of course be dispensed with, together with one of feedboxes 5, 6 and one of adjusting devices 21, and the remaining feedbox 5, 6 may be mounted, together with adjusting device 21, in a fixed position in withdrawal station 11. In this case, the user machine (not shown) must of course be stopped temporarily for inserting the stack of labels 2 inside the single feedbox and subsequently parting labels 2.

Figure 4:
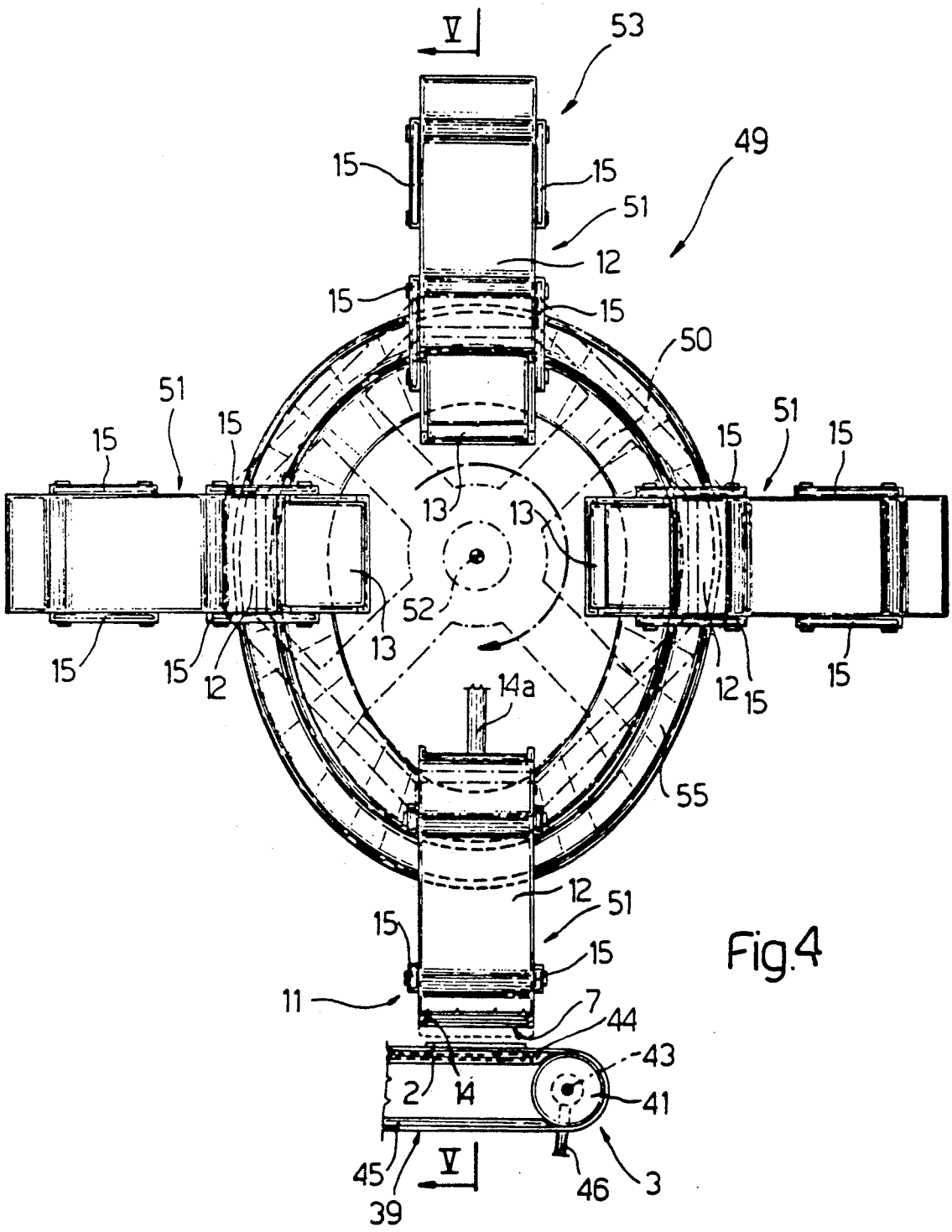
FIG. 4 shows a side view of a second preferred embodiment of the device according to the present invention.
Figure 5:
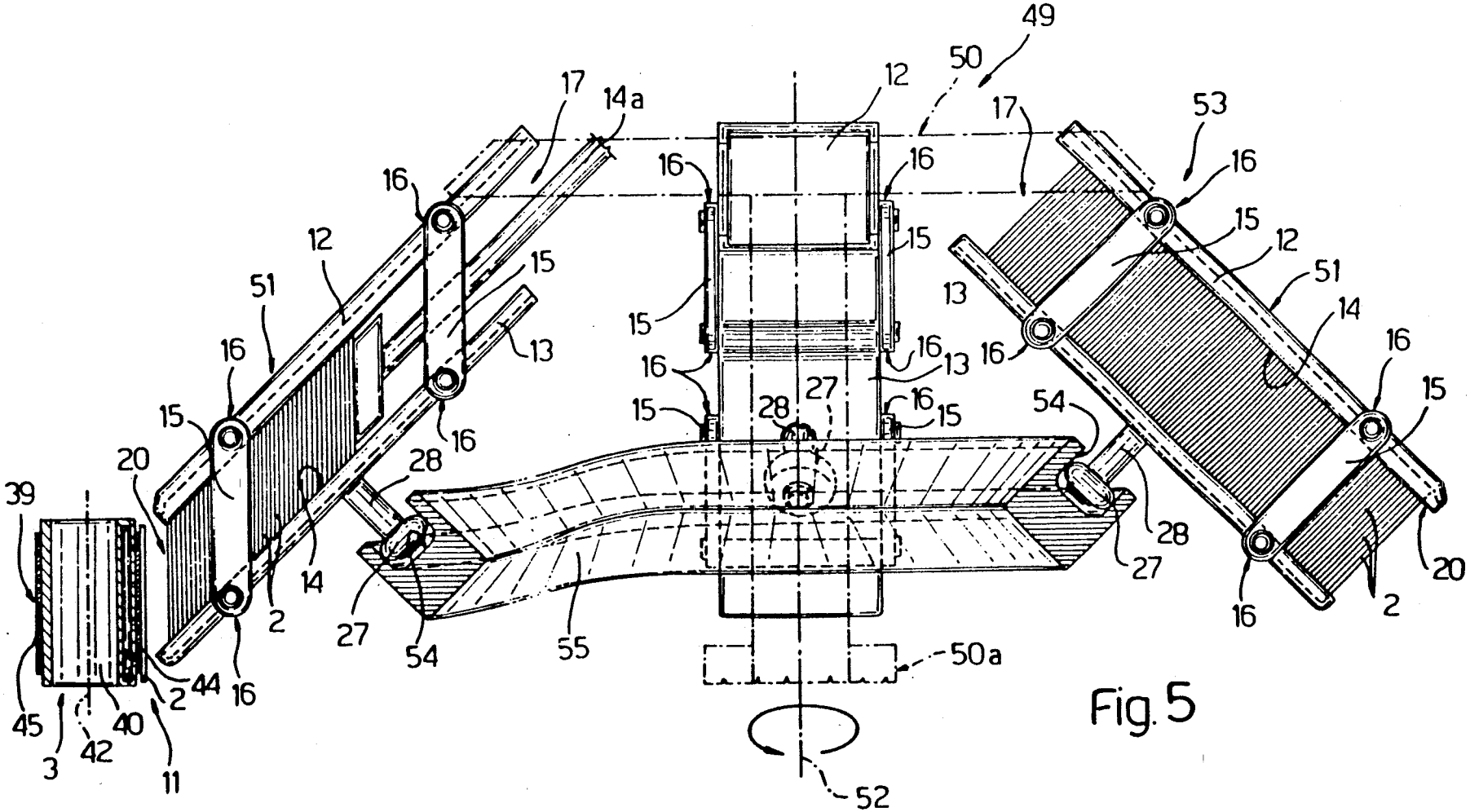
FIG. 5 shows a section along line V—V in FIG. 4.

The embodiment shown in FIGS. 4 and 5 relates to a device 49 similar to device 1, and the component parts of which are indicated where possible using the same numbering system.

On device 49, carriage 4 is replaced by an indexing fixture 50 fitted integral with walls 12 of a number of feedboxes 51, and which is rotated about axis 52 by an activating device 50*a* (shown partially), so as to successively feed feedboxes 51 through a loading station 53 and a withdrawal station 11. Feedboxes 51 are substantially identical to feedboxes 5 and 6, and each presents a roller 27 rolling inside the channel 54 of a drum type cam 55 substituting for adjusting devices 21 and so formed as to move wall 13 of each feedbox 51 into the loading position at loading station 53, and into the operating position at withdrawal station 11.

We claim:

1. A device for parting and successively feeding stacked elements of sheet material to a user machine, the device (1; 49) comprising at least one feedbox (5, 6; 51) designed to receive a stack (7; 8) of said elements (2); characterized by the fact that said feedbox (5, 6; 51) comprises a first (12) and, second (13) wall parallel to each other; and that adjusting means (21; 27, 55) are provided for moving said two walls (12; 13), in relation to and parallel to each other, between a first and second relative position, and so as to define a channel (14) varying in width between a maximum and minimum value; the section of the channel (14), when said width is maximum, being approximately equal to but no smaller than the surface of said element (2).

2. A device as claimed in claim 1, characterized by the fact that it comprises carriage means (4; 50) for supporting said feedbox (5, 6; 51); actuating means (9; 50*a*) connected to said carriage means (4; 50), for moving the feedbox (5, 6; 51) between a loading station (37, 38; 53) wherein said stack (7; 8) is loaded, and a withdrawal station (11) wherein said sheet elements (2) are withdrawn successively from the feedbox (5, 6; 51); and withdrawal means (3) located in said withdrawal station (11), for withdrawing said sheet elements (2) one by one from said feedbox (5, 6; 51).

3. A device as claimed in claim 2, characterized by the fact that it comprises at least two said feedboxes (5, 6; 51); said actuating means (9; 50*a*) moving said carriage means (4; 50) in such a manner as to move one (5, 6; 51) of the two feedboxes (5, 6; 51) into a respective said loading station (37, 38; 53), and the other (5, 6; 51) of the two feedboxes (5, 6; 51) into said withdrawal station (11).

4. A device as claimed in claim 3, characterized by the fact that each said feedbox (5, 6) presents respective said adjusting means (21) located in said respective loading station (37, 38); lock means (30) being provided for locking said respective two walls (12; 13) in said second relative position when the feedbox (5, 6) is outside said respective loading station (37, 38).

5. A device as claimed in claim 2 , characterized by the fact that said carriage means comprise an indexing fixture (50) supporting said feedboxes (51) and moving in such a manner as to move each said feedbox (51) through the withdrawal station (11) and said respective loading station (53); said adjusting means (27, 55) comprising cam means (55) common to all the feedboxes (51).

6. A device as claimed in claim 1, characterized by the fact that each said feedbox (5, 6; 51) comprises crank means (15) between said two walls (12; 13) and located laterally in relation to said channel (14); said crank means (15) defining, with said two walls (12; 13), an articulated quadrilateral structure.

* * * * *